US005650589A

United States Patent [19]

Thiesen

[11] Patent Number: 5,650,589

[45] **Date of Patent: *Jul. 22, 1997**

[54] CARTRIDGE AMMUNITION HAVING A CASE AND AN ARROW PROJECTILE

[75] Inventor: Stefan Thiesen, Willich, Germany

[73] Assignee: Rheinmetall Industrie GmbH, Ratingen, Germany

[ * ] Notice: The term of this patent shall not extend beyond the expiration date of Pat. No. 5,610,365.

[21] Appl. No.: 576,088

[22] Filed: Dec. 21, 1995

[30] Foreign Application Priority Data

Dec. 22, 1994 [DE] Germany ..... 44 45 989.0

[51] Int. Cl.[6] ..... F42B 5/18; F42B 5/26

[52] U.S. Cl. ..... 102/431; 102/289; 102/292; 102/430; 102/439; 102/470

[58] Field of Search ..... 102/202, 289, 102/292, 430, 431, 433, 434, 439, 469, 470, 521, 700

[56] References Cited

U.S. PATENT DOCUMENTS

| | | | |
|---|---|---|---|
| 186,460 | 1/1877 | Buffington | 102/470 |
| 1,354,640 | 10/1920 | Woodbridge, Jr. | 102/289 |
| 4,089,716 | 5/1978 | Goddard et al. | 149/10 |
| 4,444,115 | 4/1984 | Romer et al. | 102/430 |
| 4,572,078 | 2/1986 | Bell | 102/430 |
| 4,671,179 | 6/1987 | Synofzik et al. | 102/430 |
| 4,763,577 | 8/1988 | Romer et al. | 102/430 |
| 5,192,829 | 3/1993 | Suire | 102/439 |
| 5,325,785 | 7/1994 | Gardner | 102/430 |
| 5,400,714 | 3/1995 | Thiesen et al. | 102/431 |

FOREIGN PATENT DOCUMENTS

| | | | |
|---|---|---|---|
| 77831 | 8/1919 | Austria | 102/430 |
| 428074 | 5/1991 | European Pat. Off. | 102/430 |
| 3701145 | 8/1987 | Germany | 102/470 |
| 422735 | 1/1994 | Germany | 102/470 |

*Primary Examiner*—Harold J. Tudor
*Attorney, Agent, or Firm*—Spencer & Frank

[57] ABSTRACT

A cartridge ammunition includes a case having a case bottom; a propellant disposed in the case; a propellant igniter mounted centrally on the case bottom; an arrow projectile having a rear length portion extending into the case towards the case bottom; and a coating of igniting substance applied to at least one part of the surface of the rear projectile length portion. A clearance defined by a distance between a frontal terminus of the propellant igniter and the rear terminus of the rear length portion of the arrow projectile is such that upon igniting the propellant igniter igniting flames emanating from the propellant igniter bridge the clearance and ignite the coating of igniting substance.

11 Claims, 3 Drawing Sheets

CARTRIDGE AMMUNITION HAVING A CASE AND AN ARROW PROJECTILE

BACKGROUND OF THE INVENTION

This invention relates to a cartridge ammunition having a case and an arrow projectile. The case contains a propellant powder and has a propellant igniter arranged centrally on the case bottom. The rear portion of the arrow projectile extends into the case and is separated by a gap from the forward end of the propellant igniter.

For increasing the power of arrow projectiles (kinetic-energy penetrators) a possibly large length/diameter ratio of the arrow projectile is sought. Since the length of the cartridge is predetermined, for example, by the available weapons, the arrow projectile can be lengthened only by prolonging it at its bottom side, inwardly of the case. Such a solution, however, affects the length of the propellant igniter which extends axially from the came bottom so that often insufficient space remains available for a ballistically secure ignition of the propellant powder.

German Offenlegungsschrift (application published without examination) 41 05 255 discloses an arrow projectile cartridge in which, for ensuring a sufficient length of the projectile igniter, several igniting tubes, having radial openings, are provided in the axial direction about the rearward portion of the projectile.

It is a disadvantage of the known cartridges that, among others, the assembly and material outlay is relatively high because to ensure a uniform projectile combustion and a satisfactory ignition, at least four igniting tubes have to be arranged uniformly about the rear part of the projectile.

SUMMARY OF THE INVENTION

It is an object of the invention to provide an improved cartridge ammunition of the above-outlined type in which a secure ignition of the propellant powder and a uniform propellant combustion are achieved in a simple manner even in case of a deep penetration of the arrow projectile into the case.

This object and others to become apparent as the specification progresses, are accomplished by the invention, according to which, briefly stated, the cartridge ammunition includes a case having a case bottom; a propellant disposed in the case; a propellant igniter mounted centrally on the case bottom; an arrow projectile having a rear portion extending into the case towards the case bottom; and a coating of igniting substance applied to at least one part of the surface of the rear projectile portion. A clearance defined by a distance between a frontal terminus of the propellant igniter and the rear terminus of the rear propellant portion is such that upon igniting the propellant igniter igniting flames emanating from the propellant igniter bridge the clearance and ignite the coating of igniting substance.

Essentially, the invention is based on the principle to provide the rear portion of the arrow projectile with a layer made of an igniting substance and to arrange the propellant igniter or, as the case may be, the igniting tube filled with the igniting substance so close to the arrow projectile at its rear portion that the igniting flame generated during ignition directly ignites the igniting substance applied to the arrow projectile.

For improving and enhancing a complete ignition for the purpose of achieving a uniform propellant combustion, according to another feature of the invention, the propellant powder itself is coated with the igniting substance. The coating of the individual propellant grains is effected in a separate process prior to loading the propellant powder into the case.

It is a further advantage of the cartridge ammunition according to the invention that when using a combustible case Jacket and a non-combustible case bottom, the length of the propellant igniter may be selected such that the propellant igniter—together with the usually metal igniting tube—does not project beyond the edge of the case bottom, that is, it does not project out of the space defined by the lateral case bottom wall. In this manner, in addition to increasing the power of the arrow projectile, the handling of the case bottom subsequent to firing is significantly facilitated because no metal parts project beyond the case bottom.

By virtue of the coating of igniting substance applied to the rear part of the projectile situated within the case, the entire main propellant surrounding the projectile is ignited so that practically a central ignition extending along the entire propellant-chamber length is effected. In this manner a secure ignition and a uniform propellant combustion are achieved.

DESCRIPTION OF THE PREFERRED EMBODIMENT

Figure 1:
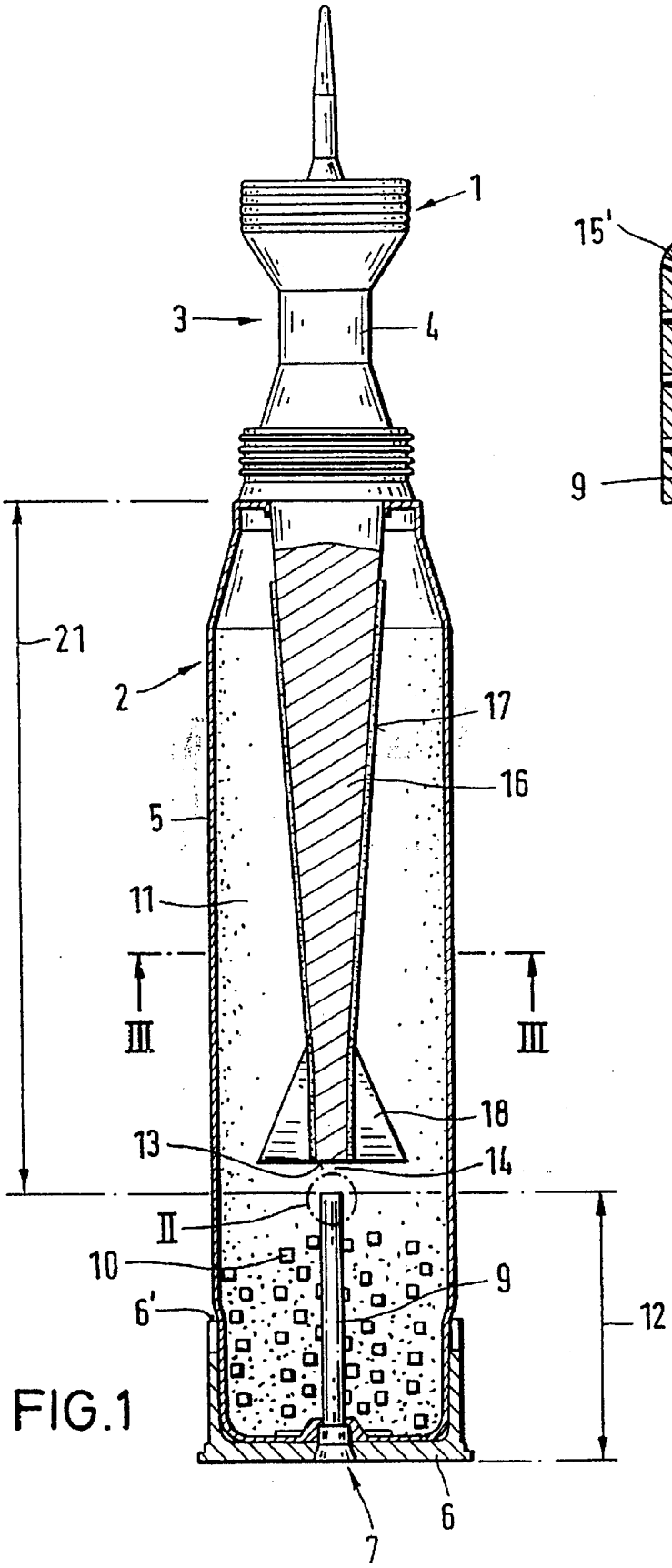
FIG. 1 is an axial sectional view of an arrow projectile cartridge according to a preferred embodiment of the invention.

Turning to FIG. 1, there is illustrated therein a cartridge ammunition generally designated at 1 which essentially has a case 2 and a subcaliber arrow projectile 3 including a sabot 4.

Figure 2:
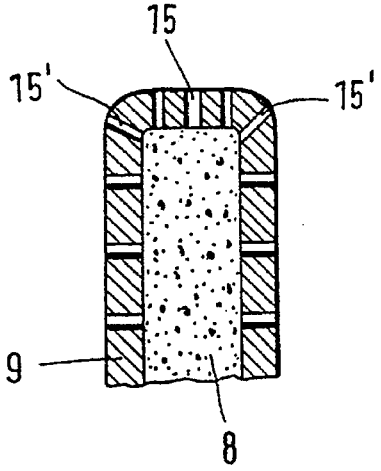
FIG. 2 is an enlarged sectional side elevational view of the inset II of FIG. 1.

The case 2 is formed of a case jacket 5 made of combustible material and a case bottom 6 made of metal and having a lateral wall terminating at an upper wall edge 6'. In the center of the case bottom 6 a propellant igniter 7 is held by a threaded connection; the igniting tube 9 (FIG. 2) of the propellant igniter 7, filled with an igniting substance 8, extends axially within the inner chamber 11 of the case 2. The inner chamber 11 is filled with propellant powder (principal propellant) 10. The length 12 of the propellant igniter 7 is so selected that between the rear terminus 13 of the arrow projectile 3 and the oppositely located forward end of the igniting tube 9 a clearance (gap) 14 of a width of approximately maximum 50 mm remains. Further, the igniting tube 9 has at its forward end oriented towards the rear terminus 13 of the arrow projectile 3, axially-oriented apertures 15 as well as obliquely-oriented apertures 15'.

Figure 4:
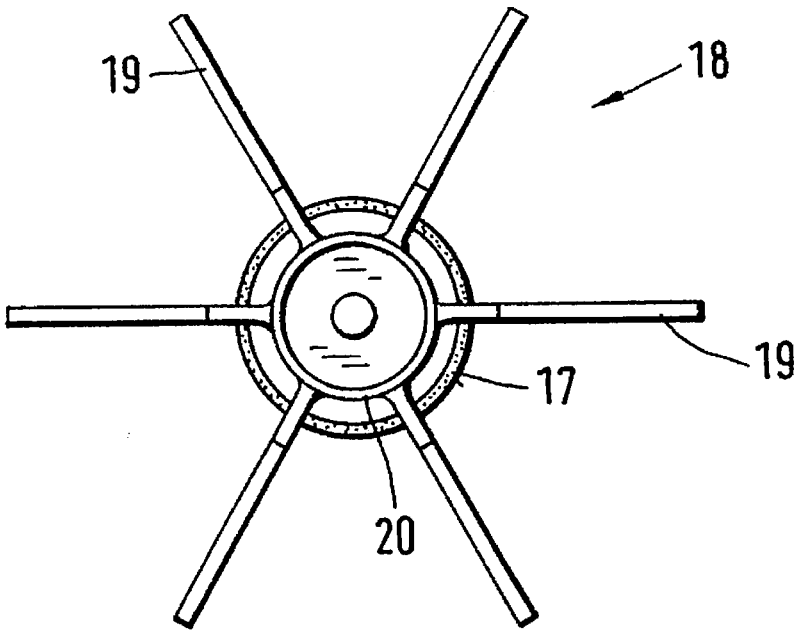
FIG. 4 is a bottom plan view of the arrow projectile illustrated in FIG. 1.

The rear length portion 16 of the arrow projectile 3, situated in the inner chamber 11 of the case 2 is, according to the invention, coated with an igniting substance 17 on a preponderant part of its surface. The igniting substance 17 extends to the rear terminus 13. As seen in FIG. 4, in the zone of the projectile guide unit 18 only the guide unit shaft 20 is provided with the igniting substance 17, while the fins 19 are free from the substance 17.

Upon firing the cartridge 1 from a non-illustrated weapon, the propellant igniter 7 and thus the igniting substance 8 in the igniting tube 9 is ignited. Igniting flames which pass through the apertures 15, 15' of the igniting tube 9 and bridge the gap 14, first impinge upon the igniting substance 17 in the zone of the guide unit shaft 20 of the arrow projectile 3 and then ignite the remainder of the coating 17. The rapidly progressing igniting flame on the rearward length portion 16 of the arrow projectile 3 ignites the entire principal propellant 10 surrounding the projectile 3.

As an igniting substance 17 for coating the rearward length portion 16 of the arrow projectile 3 either a porous igniting/propellant powder or a pyrotechnical lacquer (for example, black powder dissolved in nitrocellulose lacquer) may be used. Such a coating is characterized by a high and substantially pressure-independent flame expansion velocity (linear burning speed). The igniting substance may be applied, for example, by spraying or brushing.

It will be understood that the invention is not limited to the above-described embodiment. Thus, for example, for improving a uniform propellant combustion, in addition to the coating of the rearward length portion 16 of the arrow projectile 3, the propellant grains of the principal propellant 10 may be coated with the above-described igniting substance. In this manner the flame expansion velocity in the cartridge from below is enhanced. It is feasible to coat either all propellant grains of the principal propellant 10, or to coat only those grains which are situated above the igniting tube 9 in the zone designated at 21 in FIG. 1. The use of coated propellant grains only above the igniting tube 9 has the advantage that less coated powder needs to be used. In the zone of the igniting tube 9 there occurs then an ignition solely by means of the propellant igniter 7 which, as a rule, is sufficient.

Figure 3:
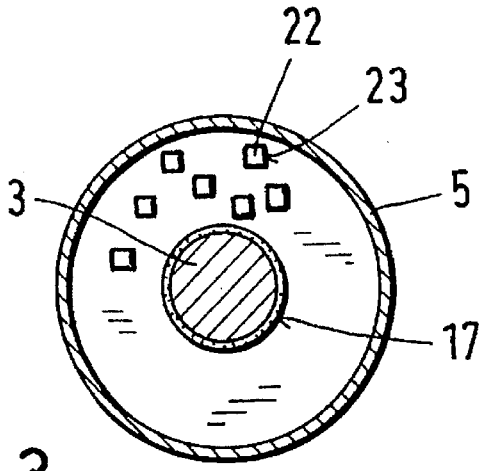
FIG. 3 is a sectional view taken along line III—III of FIG. 1.

In FIG. 3, the coated propellant grains are designated at 22 and the coating itself is designated at 23. The igniting substance with which the propellant grains are coated may be identical to that applied to the rear length portion 16 of the arrow projectile 3. For example the coating is done by spraying.

Figure 5:
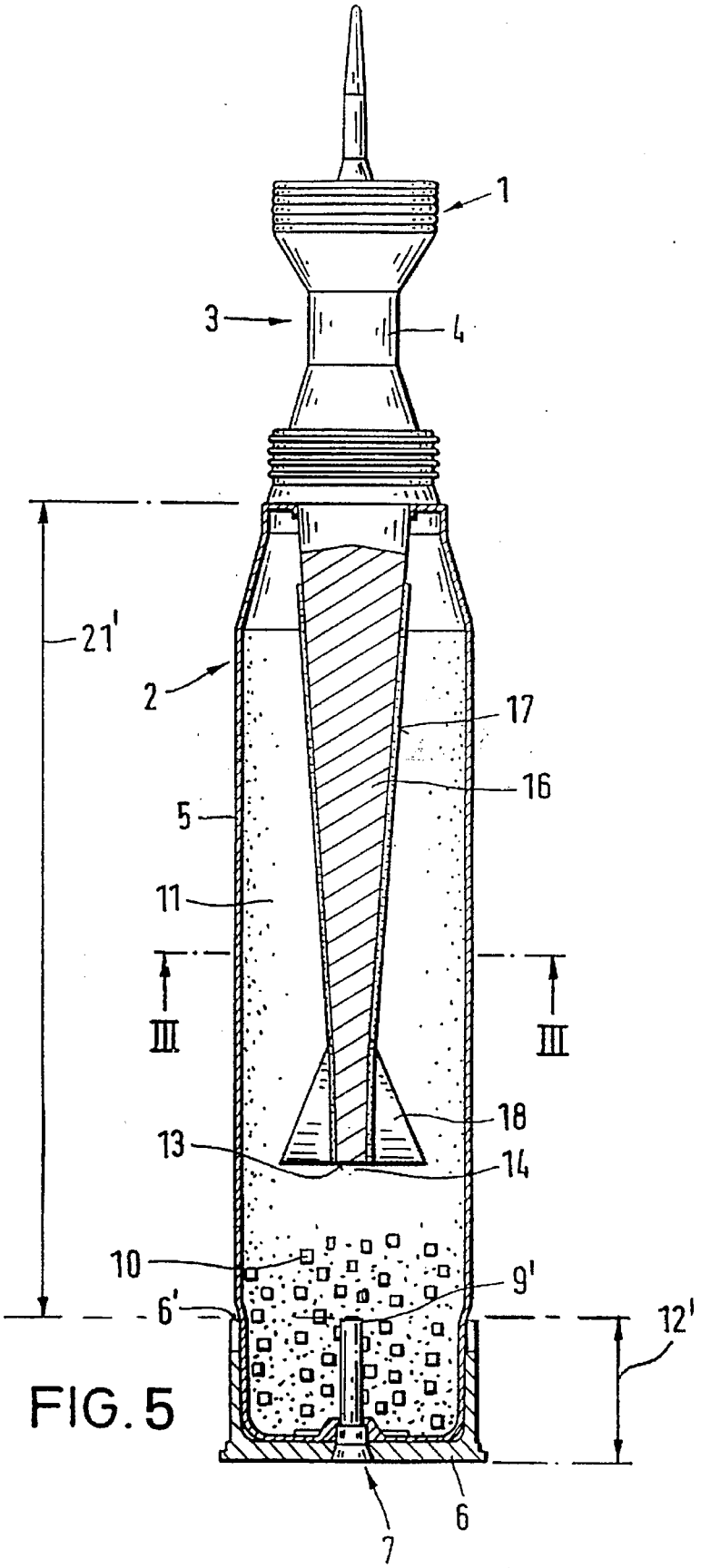
FIG. 5 is a other axial sectional view with a short igniter tube

Turning to FIG. 5, in case the jacket 5 is of a combustible material and the case bottom 6 is of a non-combustible substance, the height of the side wall of the case bottom 6 (that is, the location of the upper edge 6') and the length of the igniting tube 9' are so selected that the igniting tube 9' is situated in its entirety in the space surrounded by the wall of the case bottom 6. Such an arrangement significantly facilitates the handling of the case bottom subsequent to firing, since the tube 9' does not project beyond the wall perimeter defined by the edge 6'.

It will be understood that the above description of the present invention is susceptible to various modifications, changes and adaptations, and the same are intended to be comprehended within the meaning and range of equivalents of the appended claims.

What is claimed is:

1. A cartridge ammunition comprising (a) a case including a case bottom;

(b) a propellant disposed in said case;

(c) a propellant igniter mounted centrally on said case bottom; said propellant igniter including an igniting tube extending from said case bottom;

(d) an arrow projectile having a rear length portion extending into said case towards said case bottom; said rear length portion having a surface;

(e) a coating of igniting substance applied to at least one part of said surface; and (f) a clearance defined by a distance between a frontal terminus of said igniting tube and a rear terminus of said rear portion (1); said distance being such that upon igniting the tube igniting flames emanating from said tube bridge said clearance and ignite said coating of igniting substance.

2. The cartridge ammunition as defined in claim 1, wherein said coating of igniting substance comprises a porous igniting propellant powder.

3. The cartridge ammunition as defined in claim 1, wherein said coating of igniting substance comprises a pyrotechnical lacquer.

4. The cartridge ammunition as defined in claim 1, wherein said igniting tube is filled with an igniting substance; said igniting tube having a part oriented toward said rear terminus of said rear length portion, said part of said igniting tube being provided with apertures directing the igniting flames toward said rear length portion.

5. The cartridge ammunition as defined in claim 4, wherein some of said apertures are axially oriented.

6. The cartridge ammunition as defined in claim 4, wherein some of said apertures are obliquely oriented.

7. The cartridge ammunition as defined in claim 1, wherein said distance is maximum 50 mm.

8. The cartridge ammunition as defined in claim 1, wherein said case is combustible and said case bottom is non-combustible; said case bottom having a side wall terminating in a frontal or upper edge; said igniting tube being situated entirely within a space defined be said side wall and bounded by said upper edge.

9. The cartridge ammunition as defined in claim 1, wherein said propellant comprises propellant grains coated with an igniting substance identical to the igniting substance applied to said rear length portion of said arrow projectile.

10. The cartridge ammunition as defined in claim 9, wherein said propellant grains are situated solely in a case zone located axially beyond said propellant igniter.

11. The cartridge ammunition as defined in claim 1, wherein said coating of igniting substance extends to said rear terminus of said rear length portion.

* * * * *